US007741969B2

(12) United States Patent
Linford

(10) Patent No.: US 7,741,969 B2
(45) Date of Patent: Jun. 22, 2010

(54) DOOR ENTRY SECURITY DEVICE WITH ELECTRONIC LOCK

(75) Inventor: Karl M Linford, East Northport, NY (US)

(73) Assignee: Honeywell International Inc., Morristown, NJ (US)

( * ) Notice: Subject to any disclaimer, the term of this patent is extended or adjusted under 35 U.S.C. 154(b) by 376 days.

(21) Appl. No.: 11/729,899

(22) Filed: Mar. 28, 2007

(65) Prior Publication Data

US 2008/0238669 A1 Oct. 2, 2008

(51) Int. Cl.
*E05B 45/06* (2006.01)

(52) U.S. Cl. ..... 340/542; 70/91

(58) Field of Classification Search ..... 340/542, 340/426.1, 426.13, 426.28, 426.36
See application file for complete search history.

(56) References Cited

U.S. PATENT DOCUMENTS 3,936,673 A * 2/1976 Kelly et al. ..... 307/10.3
4,035,791 A * 7/1977 Katayama ..... 340/522
4,926,160 A * 5/1990 Hwang ..... 340/426.28
5,999,095 A * 12/1999 Earl et al. ..... 340/542
6,225,903 B1 5/2001 Soloway et al.
6,255,957 B1 * 7/2001 Sonderegger et al. .... 340/686.1
6,441,735 B1 * 8/2002 Marko et al. ..... 340/542
6,812,836 B2 * 11/2004 Soloway et al. ..... 340/542
6,956,467 B1 * 10/2005 Mercado, Jr. ..... 340/426.2
6,963,280 B2 11/2005 Eskildsen
6,970,084 B2 * 11/2005 Kwon ..... 340/542
7,142,111 B2 * 11/2006 Eskildsen et al. ..... 340/542
7,274,293 B2 * 9/2007 Bradus et al. ..... 340/568.2
2004/0174247 A1 * 9/2004 Rodenbeck et al. ..... 340/5.64
2005/0046564 A1 * 3/2005 Eskildsen et al. ..... 340/506
2005/0140496 A1 * 6/2005 Magner et al. ..... 340/5.54
2005/0270144 A1 * 12/2005 Parnaby ..... 340/426.13
2006/0250215 A1 * 11/2006 Norton ..... 340/5.64

* cited by examiner

*Primary Examiner*—Toan N Pham
*Assistant Examiner*—Kerri McNally
(74) *Attorney, Agent, or Firm*—Barkume & Associates, P.C.

(57) ABSTRACT

An alarm system and method for (1) assisting a user in arming and disarming an alarm system when locking and unlocking an entry door, (2) automatically locking an entry door when arming the alarm system, and/or (3) remotely controlling an electronic lock in an entry door.

12 Claims, 6 Drawing Sheets

DOOR ENTRY SECURITY DEVICE WITH ELECTRONIC LOCK

TECHNICAL FIELD

This invention relates to security systems, and in particular to an alarm system that assists a user by automatically arming or disarming when an entry door is locked or unlocked. Other features of the alarm system include automatically locking an entry door when the alarm system is armed by the user, being able to remotely lock or unlock an entry door, and preventing arming of the alarm system when a door is unlocked.

BACKGROUND ART

Occupants of a home usually arm their home's alarm system when they are away from their home or when they are retired for the evening. Most other times the alarm system is disarmed. When the alarm system determines that an intruder has invaded the home, it sounds a local alarm and notifies a remote central control station of the intrusion. The central control station consequently sends security personnel to investigate the intrusion. The occupants of a home feel safe knowing that if the alarm has not sounded, there has been no intrusion into their home. If the alarm has sounded, security personnel are on their way to the home.

Problems arise when the system is not properly armed and disarmed. Typical problems users have include not disarming the system before the alarm sounds and the central control station is notified. This may occur when the user unlocks and enters the home but becomes distracted or takes too long before entering the disarm code into the alarm system keypad. Another common mistake users make is not arming the alarm system when the home is unoccupied. This may occur when the user simply forgets to arm the alarm system possibly due to exiting a door that is not near the alarm system keypad. Having an alarm system that allows the user to use a single action to unlock an entry door and disarm the alarm system or lock the entry door and arm the alarm system would eliminate these problems.

Another problem that may occur is the user may forget to lock an entry door after leaving or entering the home. If the user is home, he may arm the alarm system and think his home is secure. Having an alarm system that locks the doors when the system is armed eliminates this problem. An alternative solution is to prevent the alarm system from arming if a door is unlocked. In this solution, when the user tries to arm the alarm system but is unable to, he will know a door is unlocked (or open). If the user is away, he may worry that he has forgotten to lock the entry door. Having an alarm system that allows the user to remotely communicate to his alarm system to lock the entry door to his home would solve this problem. An additional user problem may occur when he is locked out of the house. Having an alarm system that allows the user to unlock the entry door remotely would solve this problem.

It is therefore an object of the present invention to provide an alarm system that disarms the alarm system when the entry door is unlocked.

It is a further object of the present invention to provide an alarm system that arms the alarm system when the homeowner locks the entry door.

It is a further object of the present invention to provide an alarm system that locks the entry door when the homeowner arms the alarm system.

It is a further object of the present invention to provide an alarm system that prevents the homeowner from arming the alarm system when the entry door is not locked.

Finally it is a further object of the present invention to provide an alarm system that unlocks or locks the entry door remotely.

DISCLOSURE OF THE INVENTION

The present invention is an alarm system for assisting a user in arming and disarming the alarm system when locking and unlocking an entry door. The alarm system of the present invention includes an alarm system control panel and a door entry security device that selectively locks and unlocks the entry door. The door entry security device includes a transmitter, an electronic lock and processing circuitry. The door entry security device may also include a coded user input device reader which provides an electronic lock command to the processing circuitry. The coded user input device reader may be a mechanical token (or key) acceptor, a key fob reader, a card swipe reader, or keypad reader. The coded user input device reader authenticates the coded user input device by methods known to one skilled in the art. Once the processing circuit detects the electronic lock command, it triggers the electronic lock to perform the command and it initiates the transmitter to transmit an electronic lock status message based on the electronic lock command. The alarm system control panel receives the electronic lock status message and performs an alarm system function based on the electronic lock status message. The electronic lock status message may be an unlock message causing the alarm system control panel to disarm the alarm system, or a lock message causing the alarm system control panel to arm the alarm system. A benefit of the present invention is that the user does not have to enter an additional security code into the alarm system to arm or disarm it. It is assumed that a person who has the entry door keypad code (or key) will also be authorized to access the alarm system. The processing circuit of the door entry security device is adapted to store the electronic lock position based on the electronic lock commands. The door entry security device of the present invention does not need to sense the presence or motion of a deadbolt in the door jamb to determine the lock position as in the prior art. The door entry security device locally performs the authentication of the coded user input and controls the electronic lock, while the alarm system control panel locally performs the associated alarm function. This operation is different from other alarm systems where a central processor performs the unlock function and the alarm functions.

The door entry security device of the present invention may also contain a tamper detection device. In this embodiment, the electronic lock status message is a tamper message (transmitted when the tamper detection device determines that the door entry security device has been tampered with), causing the alarm system control panel to set off an alarm notification.

The method of automatically controlling the alarm system when locking or unlocking the entry door includes the steps of generating a coded user input signal, detecting by a door entry security device the coded user input signal, authenticating by a door entry security device the coded user input signal, transmitting from the door entry security device an electronic lock status message as a function of an electronic lock position, receiving the electronic lock status message by an alarm system control panel, processing by the alarm system control panel the electronic lock status message to generate an alarm system command, and executing the alarm system command. The coded user input signal may generate a locked position which causes the alarm system to be armed, or may generate an unlocked position which causes the alarm system to be disarmed. The coded user input signal may be generated by a coded user input device such as a mechanical token (or key) acceptor, a key fob reader, a card swipe reader, or keypad reader as stated above. After receiving the coded user input signal, the door entry security device performs the step of executing the function of locking or unlocking the electronic lock in addition to transmitting the electronic lock status message.

Furthermore, the present invention is an alarm system and method of automatically locking an entry door when arming the alarm system. In this embodiment of the present invention, the alarm system control panel generates a lock message when a user arms the alarm system and transmits the lock message to the door entry security device. The door entry security device, which also contains a receiver, receives the lock message from the control panel, processes the received lock message and controls the electronic lock to lock an entry door. The method includes the steps of inputting an arm command to an alarm system control panel, transmitting from the alarm system control panel a lock message, receiving at a door entry security device the transmitted lock message, processing by the door entry security device the received lock message, and locking the electronic lock.

The present invention is also a method of remotely controlling an electronic lock in an entry door. Because the alarm system control panel of the present invention has the ability to communicate with the door entry security device and with a person at a remote location, through a data network or a telephone network, the person at the remote location can send a lock or unlock command to the alarm system which in turn sends a lock or unlock message to the door entry security device, which cause the electronic lock to lock or unlock. The method includes the steps of receiving by the alarm system control panel a control command from a remote location. The control command may be an unlock message or a lock message. The method includes processing by the alarm system control panel the control command, transmitting from the alarm system control panel to a door entry security device a control message, receiving by the door entry security device the transmitted control message, processing by the door entry security device the received control message to generate an electronic lock control signal, and controlling the electronic lock based on the electronic lock control signal. The method further includes the step of transmitting the control command to the alarm system control panel from a remote location, such as a central control station. The control command may also be transmitted over a telephone network from a telephone or over a data network, such as the Internet, from a computer.

Finally the present invention includes a system and method of preventing the alarm system from being armed. The method includes the steps of unlocking the electronic lock, transmitting by the door entry security device an unlocked status message, receiving the unlocked status message by an alarm system control panel, processing by the alarm system control panel the unlock status message to disable arming of the alarm system by a user.

BEST MODE FOR CARRYING OUT THE INVENTION

Figure 1:
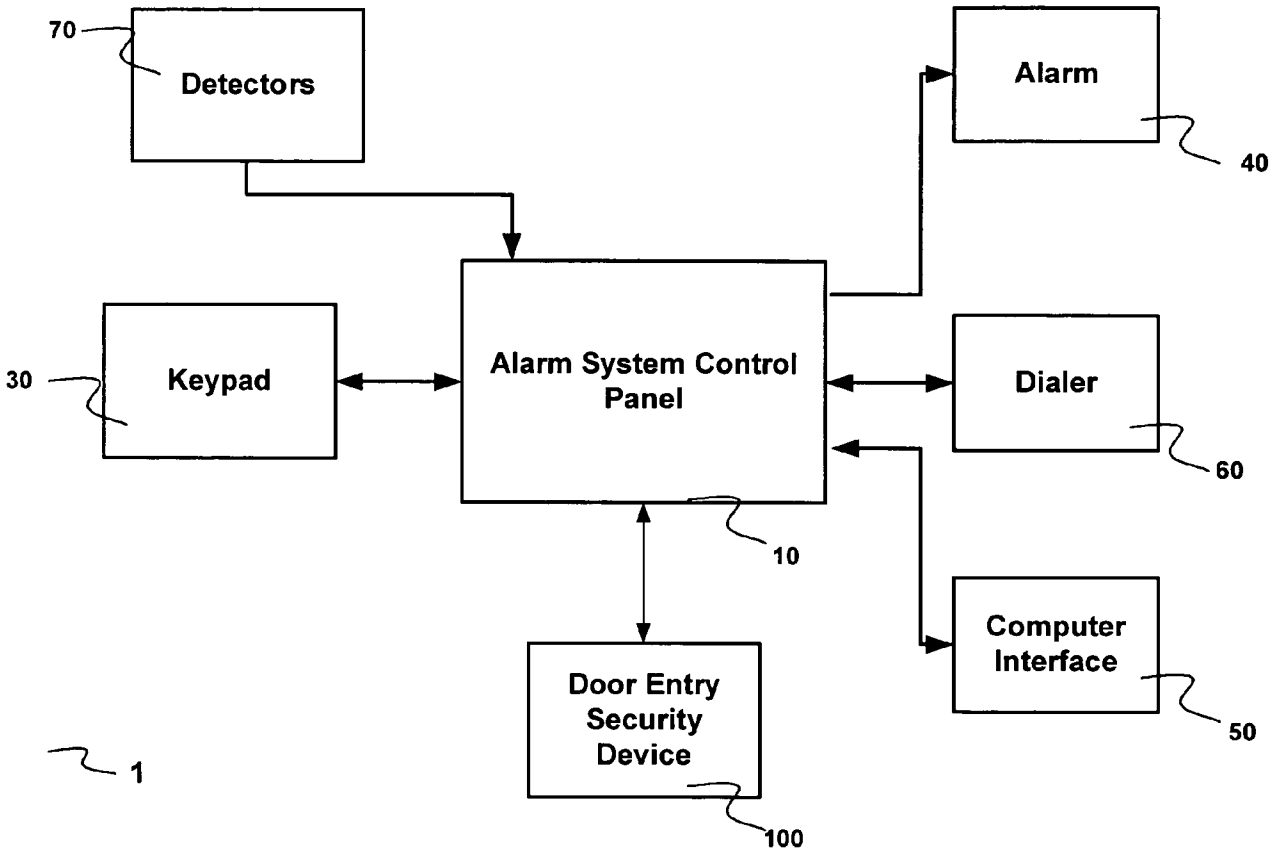
FIG. 1 is a diagram of an alarm system with a door entry security device in a home.

The preferred embodiments of the present invention will now be described with respect to the Figures. FIG. 1 shows a block diagram of an alarm system 1 which includes an alarm system control panel 10, an alarm 40, a dialer 60 for calls to/from a central monitoring station, a computer interface 50, a keypad 30, intrusion detectors 70 (which may be wired or wireless,) and a door entry security device 100. Novel features of the present invention include the ability of the alarm system control panel 10 to automatically arm or disarm itself based on the functions of the door entry security device 100 and the ability of the door entry security device 100 to automatically lock or unlock based on the functions of the alarm system control panel 10. In the present invention, when an entry door is unlocked, the door entry security device 100 sends an unlock message to the alarm system control panel 10 and the alarm system control panel 10 automatically disarms the alarm system 1. There is no need for the user to walk to the keypad 30 (which may not be near the entry door) and enter an authorization code to disarm the alarm system 1. The operations of the detectors 70, alarm 40, keypad 30 and dialer 60 in conjunction with the alarm system control panel 10 are known in the art and need not be repeated herein.

Figure 2:
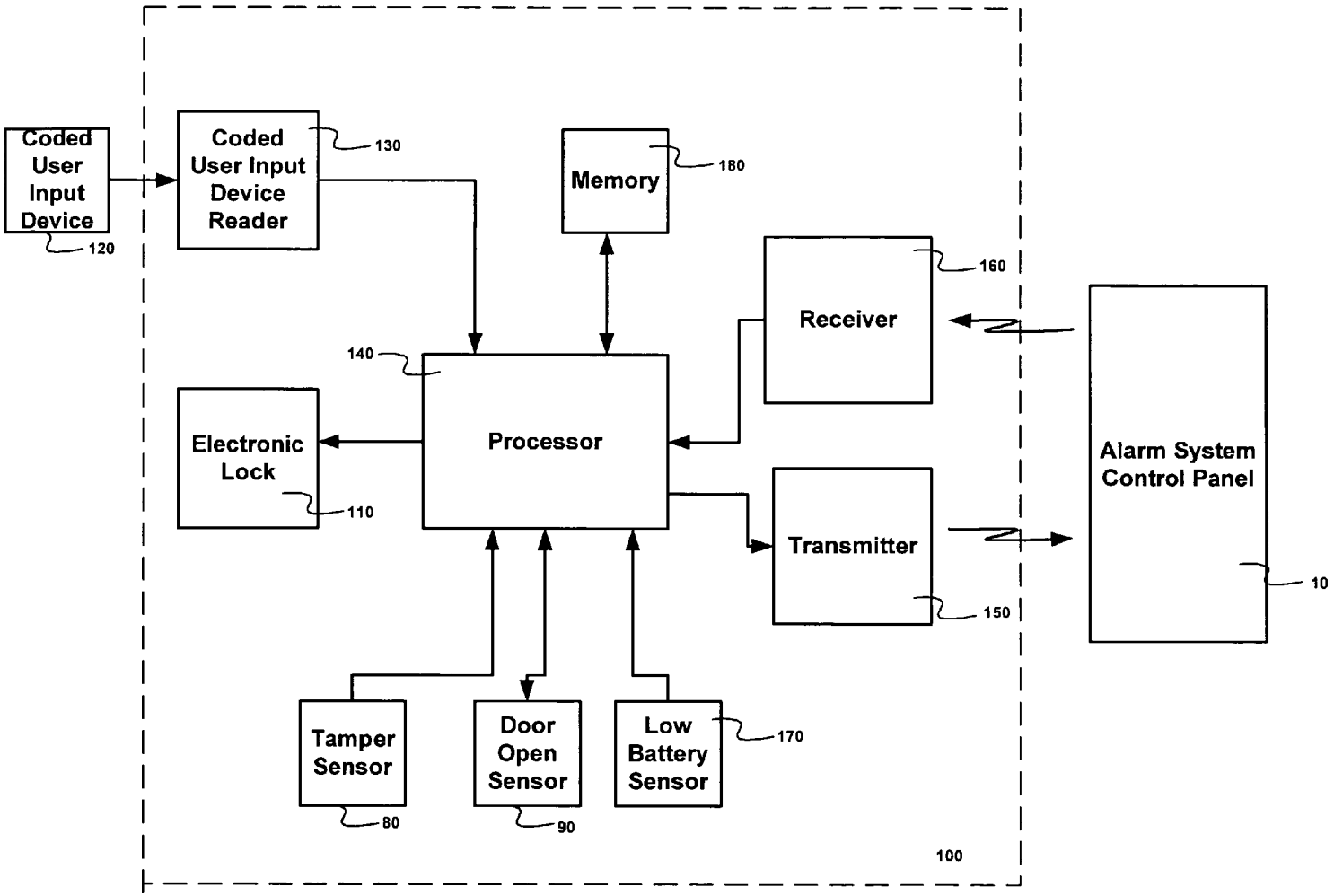
FIG. 2 is a block diagram of a preferred embodiment of the present invention.

FIG. 2 shows a block diagram of the door entry security device 100 in communication with the alarm system control panel 10, which is remotely located from the door entry security device 100. The door entry security device 100 consist of an electronic door lock 110, a coded user input device reader 130, a processor 140, memory 180, a receiver 160, a transmitter 150, a door open/closed sensor 90, a tamper detection sensor 80, and a low battery sensor 170. The door entry security device 100 operates in the following manner. A user generates a coded signal from a coded user input device 120, which may be a mechanical token such as a metal key, a keypad, a fingerprint scanner, a magnetic card swipe, or other similar device. The coded signal is read by the coded user input device reader 130. The coded user input device reader 130 determines, by methods known in the art, if the user is authorized to enter the home. Once the coded user input device reader 130 has received an authorized coded signal, it sends an electronic lock command to the processor 140. When the processor 140 receives the electronic lock command, it locks or unlocks the electronic lock mechanism 110 depending on the previous state of the electronic lock mechanism, which the processor 140 stores in memory 180. The electronic lock mechanism 110 may be a deadbolt, in which case the processor 140 controls the actuator that moves the deadbolt in a manner known in the art. Alternatively, the electronic lock mechanism 110 may be a magnetic lock in which case the processor 140 controls the current to generate the magnetic field. The processor 140 then initiates the transmitter 150 to transmit a message containing the lock/unlock status of the electronic lock mechanism 110 to the remotely located alarm system control panel 10. Based on the lock/unlock status, the alarm system control panel 10 arms or disarms the alarm system 1. The processor 140 also receives information from the tamper sensor 80, the door open sensor 90 and the low battery sensor 170 which are also transmitted to the alarm system control panel 10. If desired, the alarm system control panel 10 uses the door open information to prevent a user from arming the alarm system 1 when a door is open. The alarm system control panel 10 uses the tamper information to sound the alarm 40 and contact the central control station monitoring the alarm system 1 through the dialer 60. The low battery information is used to alert the user of the low battery status.

Figure 3:
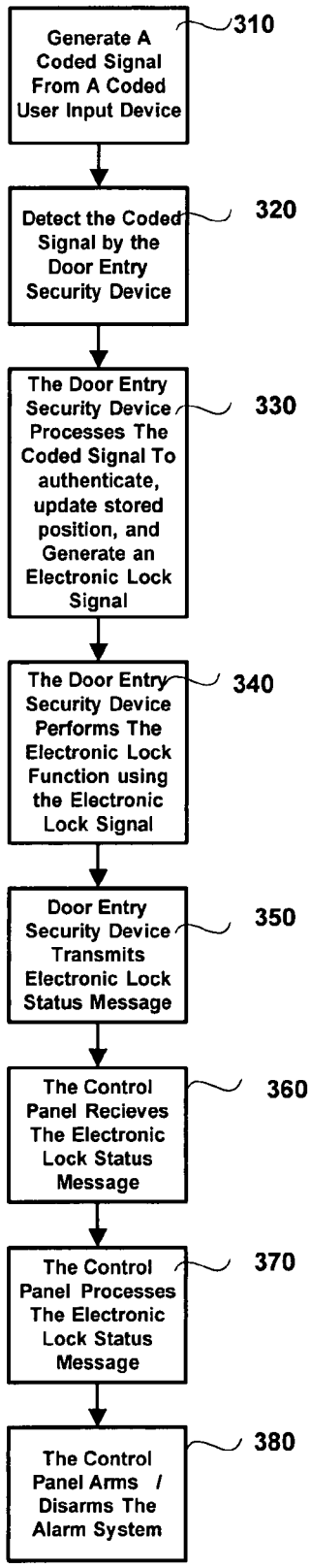
FIG. 3 is a mode of operation flowchart for automatically controlling an alarm system when locking or unlocking an entry door.

FIG. 3 shows a flowchart of the unlocking/locking of the electronic lock 110 controlling the alarm system 1 functions. In step 310 a coded signal is generated from a coded user input device 120 and detected by the door entry security device 100 in step 320. In step 330 the door entry security device 100 processes the coded signal which includes checking if it is an authorized coded user input device 120, updating a stored position in memory, and generating an electronic lock signal based on the stored position. In step 340 the door entry security device 100 performs the electronic lock function using the electronic lock signal and in step 350 transmits to the alarm system control panel 10 an electronic lock status message based on the updated stored electronic lock position. In step 360 the alarm system control panel 10 receives the electronic lock status message and in step 370 processes it to determine if the alarm system 1 should be armed or disarmed based on the electronic lock status message and in step 380 performs the task.

Figure 4:
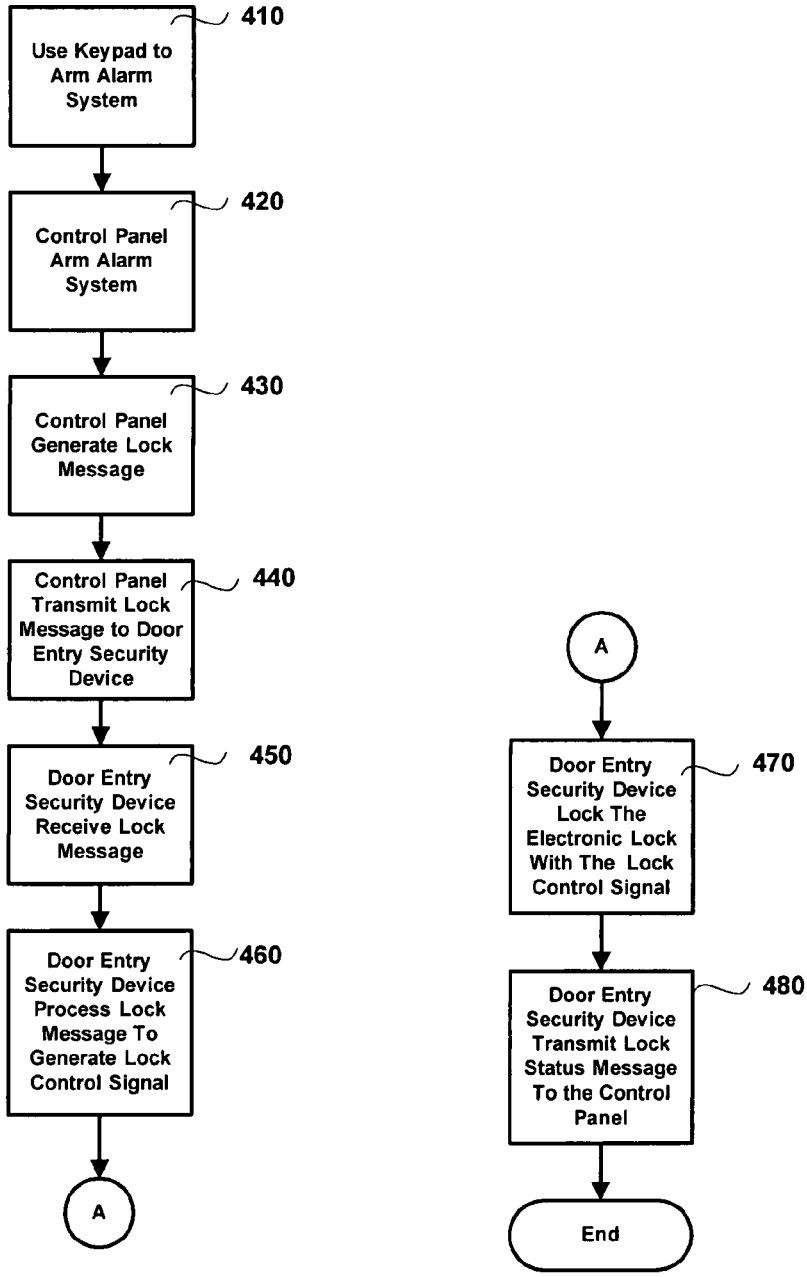
FIG. 4 is a mode of operation flowchart for automatically locking an entry door when arming an alarm system.

The alarm system 1 of the present invention includes several other unique features. Shown in the flowchart in FIG. 4, a user arms the alarm system 1 (in step 410) using alarm system keypad 30 (which is likely the case when he is staying home). In step 420 the alarm system control panel 10 will arm the alarm system, generate the lock message in step 430, and in step 440 transmit a lock message to the door entry security device 100. In step 450 the door entry security device 100 receives the lock message and generates a lock control signal in step 460, which will cause the door entry security device 100 (or more specifically the processor 140) to lock the electronic lock 110 in step 470. The door entry security device 100 will then transmit a lock status message to the alarm system control panel 10 in step 480, alerting it that the entry door was locked.

Figure 5:
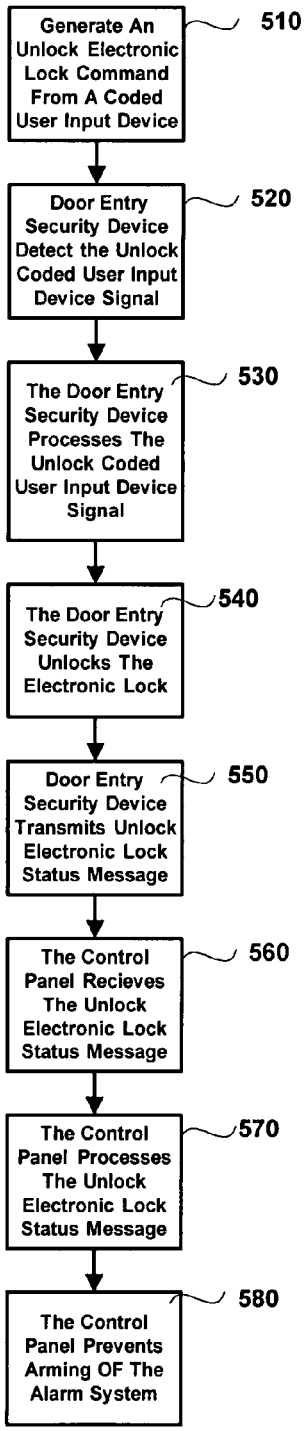
FIG. 5 is a mode of operation flowchart for remotely controlling an alarm system.

Additionally the alarm system control panel 10 can be programmed to prevent arming of the alarm system 1 when the entry door is unlocked (similarly to an opened entry door). FIG. 5 shows the flowchart of this feature. In step 510, an unlock coded signal is generated from a coded user input device 120 (which may be simply the user unlocking the door). The door entry security device 100 detects the unlock coded signal in step 520, processes it in step 530 as above, unlocks the electronic lock 110 in step 540, and transmits an unlock electronic lock status message in step 550. The alarm system control panel 10 receives the unlock electronic lock status message in step 560 and in step 570 sets a flag that the alarm system control panel 10 checks before arming the alarm system 1. As long as the flag is set the alarm system control panel 10 will not arm the alarm system 1 in step 580. The flag will be reset by the alarm system control panel 10 when the electronic lock 110 is locked. This feature would prevent the situation where a user arms the alarm system 1 thinking his home is secure when in reality it is not due to an unlocked entry door.

Figure 6:
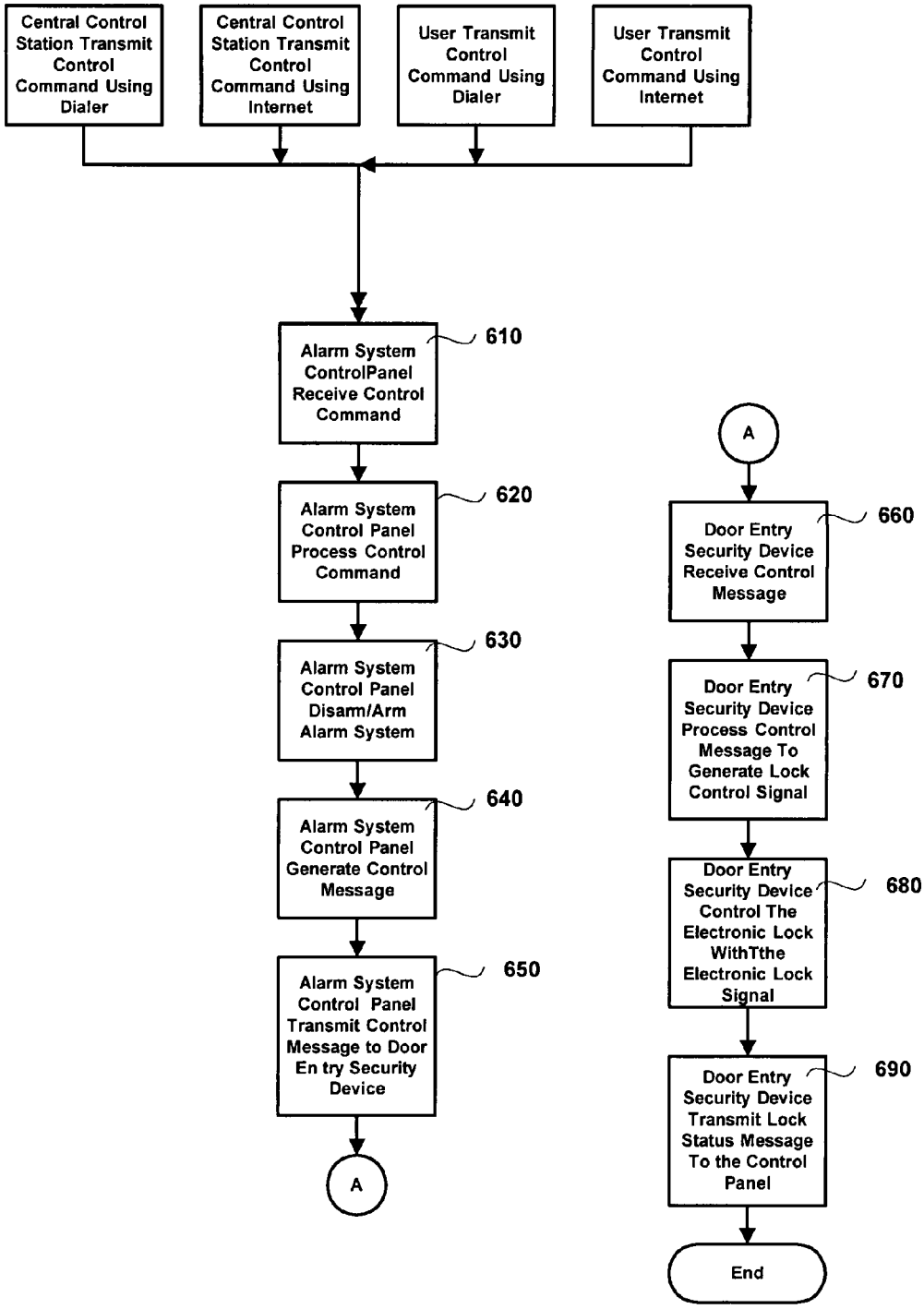
FIG. 6 is a mode of operation flowchart for preventing arming of an alarm system when a door is unlocked.

Another feature of the present invention is that the central control station or a user can contact the alarm system control panel 10 through the dialer 60 or the computer interface 50 and command the alarm system 1 to lock or unlock the entry door. FIG. 6 shows a flowchart of this feature. The alarm system control panel 10 receives a control command in step 610, which may be either lock or unlock, from the central control station or from a user, through a telephone network connected to the dialer 60 or through a computer network such as the Internet connected to the computer interface 50. In step 620 the alarm system control panel 10 processes the control command, arms or disarms the alarm system 1 in step 630, generates a control message based on the control command in step 640, and transmits the control message to the door entry security device 100 in step 650. The door entry security device 100 receives the control message in step 660, processes it to generate a lock control signal in step 670, locks/unlocks the electronic lock 110 based on the lock control signal in step 680, and transmits a lock status message to the alarm system control panel 10 in step 690. The alarm system control panel 10 may further transmit the lock status message to the user or the central control station. This feature is useful when a user is locked out of his home, when the user wants to make sure his entry door is locked, or when the user wants to remotely allow someone entry to his home.

It will be apparent to those skilled in the art that modifications to the specific embodiment described herein may be made while still being within the spirit and scope of the present invention. For example, other coded user input devices readers 130 may be used such as a biometric reader. The door entry security device 100 may be wired rather than wireless. The electronic lock 110 may be different from a dead bolt lock or a magnetic lock, and there may be a number of door entry security devices 110 communicating with the alarm system control panel 10.

What is claimed is:

1. An alarm system comprising:

a. a door entry security device suitable for mounting on an entry door, said door entry security device comprising:

i. an electronic lock mechanism adapted to selectively lock and unlock an entry door on which the door entry security device is mounted, the electronic lock mechanism having a locked position or an unlocked position, ii. a memory for storing the position of the electronic lock mechanism;

iii. a coded user input device reader for detecting a user input for locking or unlocking the entry door and generating an electronic lock command;

iv. processing circuitry adapted to receive the electronic lock command from the coded user input device reader, change the position of the electronic lock mechanism based on the position stored in the memory, and update the memory to the changed position of the electronic lock mechanism, and v. a transmitter to transmit an electronic lock status message as a function of the updated position of the electronic lock mechanism stored in the memory, and b. an alarm system control panel remotely located from said door entry security device and adapted to receive said electronic lock status message, to process said electronic lock status message to determine an alarm system function that should be performed, and to perform an alarm system function based on the electronic lock status message.

2. The system of claim 1 wherein said electronic lock status message is an unlock message and said alarm system function performed is disarming of the alarm system.

3. The system of claim 1 wherein said electronic lock status message is a lock message and said alarm system function performed is arming of the alarm system.

4. The system of claim 1 further comprising a door open sensor to sense if the entry door is open, wherein said electronic lock status message indicates if said entry door is open as indicated by the door open sensor and said alarm system function performed is to prevent arming of the alarm system when said entry door is open as indicated by the electronic lock status message.

5. The system of claim 1 wherein said door entry security device further comprises a receiver for receiving messages from the alarm system control panel.

6. The system of claim 1 wherein said electronic lock command is generated from mechanical interaction of a token with said coded user input device reader.

7. The system of claim 1 wherein said electronic lock command is generated from an electrical transmission to said coded user input device reader.

8. The system of claim 1 wherein said door entry security device further comprises a tamper detection device, and wherein said alarm system function performed is alarm notification when said tamper detection device determines the door entry security device has been tampered with.

9. A method of automatically controlling an alarm system, comprising the steps of:

a. storing a locked position or an unlocked position of an electronic lock mechanism in a memory of a door entry security device, b. detecting a user input signal for locking or unlocking an entry door, c. generating an electronic lock command from the user input signal, d. changing the position of the electronic lock mechanism based on the position stored in the memory, e. updating the memory to the changed position of the electronic lock mechanism, f. transmitting from said door entry security device to a remotely located alarm system control panel an electronic lock status message as a function of the updated position of the electronic lock mechanism stored in the memory, g. receiving said electronic lock status message by the remotely located alarm system control panel, h. processing by the remotely located alarm system control panel said electronic lock status message to determine an alarm system function that should be performed, and i. the remotely located alarm system control panel performing an alarm system function based on the electronic lock status message.

10. The method of claim 9 wherein said electronic lock status message is an unlock message and said alarm system function performed is disarming of the alarm system.

11. The method of claim 10 further comprising the step of the door entry security device executing an electronic lock function based on the user input signal.

12. The method of claim 9 wherein said electronic lock status message is a lock message and said alarm system function performed is arming of the alarm system.

* * * * *